US009569908B2

(12) United States Patent
Houben et al.

(10) Patent No.: US 9,569,908 B2
(45) Date of Patent: Feb. 14, 2017

(54) CASH CASSETTE WITH ELECTRONIC MONEY SEAL

(75) Inventors: Ralf Houben, Paderborn (DE); Oliver Dietz, Borchen (DE); Marco Goltz, Berlin (DE)

(73) Assignee: Wincor Nixdorf International GmbH (DE)

( * ) Notice: Subject to any disclaimer, the term of this patent is extended or adjusted under 35 U.S.C. 154(b) by 147 days.

(21) Appl. No.: 13/991,483

(22) PCT Filed: Dec. 7, 2011

(86) PCT No.: PCT/EP2011/072046
§ 371 (c)(1),
(2), (4) Date: Jul. 17, 2013

(87) PCT Pub. No.: WO2012/076592
PCT Pub. Date: Jun. 14, 2012

(65) Prior Publication Data

US 2014/0299658 A1 Oct. 9, 2014

(30) Foreign Application Priority Data

Dec. 7, 2010 (DE) ..... 10 2010 061 069

(51) Int. Cl.
*G07D 11/00* (2006.01)

(52) U.S. Cl.
CPC ..... *G07D 11/0009* (2013.01); *G07D 11/0042* (2013.01)

(58) Field of Classification Search
CPC ..... G07D 11/0009; G07D 11/0012; G07D 11/0042; G07F 7/04; G07F 19/201; E05G 1/005; E05G 1/026; E05G 1/04; B65H 2701/1912; E05C 19/06
(Continued)

(56) References Cited

U.S. PATENT DOCUMENTS 1,890,912 A * 12/1932 Momm ..... E05B 65/5253 292/103
2,792,961 A * 5/1957 Gordon ..... A01K 97/06 220/326
(Continued)

FOREIGN PATENT DOCUMENTS

CN 201359815 Y 12/2009
DE 69928440 T2 7/2006
(Continued)

OTHER PUBLICATIONS

International Preliminary Report on Patentability for PCT/EP2011/072046 (Jun. 20, 2013) with English translation (18 pages).
(Continued)

*Primary Examiner* — William Miller
(74) *Attorney, Agent, or Firm* — Harness, Dickey & Pierce, P.L.C.

(57) ABSTRACT

The invention relates to a device (10, 30, 40, 50) for receiving notes of value, comprising a base body (12) and a lid (14) for closing an opening of the base body (12). Another aspect of the invention relates to a device (60) for displaying the opening of a lid (14) closing an opening of a base body (12) of a cash box (10, 30, 40, 50, 80). Both devices (10, 30, 40, 50, 60) comprise a sensor (16, 64) for detecting the opening of the lid (14) and a display unit (18). Further, the devices (10, 30, 40, 50, 60) comprise a control unit (20) that controls the display unit (18) in such a manner that, at least when the sensor (16, 64) has detected an unauthorized opening of the lid (14), that the display unit (18) displays information on the opening of the lid (14).

14 Claims, 2 Drawing Sheets

(58) Field of Classification Search
USPC ..... 232/1 D, 15, 16, 44; 235/379; 902/9, 13; 194/206; 109/24.1, 47; 292/DIG. 38, 87
See application file for complete search history.

(56) References Cited

U.S. PATENT DOCUMENTS

| | | | | |
|---|---|---|---|---|
| 3,822,905 | A * | 7/1974 | Bell | E05C 19/06 206/541 |
| 4,544,191 | A * | 10/1985 | Nakama | E05B 63/244 292/341.12 |
| 4,863,208 | A * | 9/1989 | Streett | B60R 7/04 292/DIG. 72 |
| 5,577,779 | A * | 11/1996 | Dangel | E05C 19/06 220/326 |
| 5,689,243 | A | 11/1997 | Bianco | |
| 5,936,523 | A | 8/1999 | West | |
| 6,402,025 | B1 | 6/2002 | Shepherd et al. | |
| 6,626,354 | B1 * | 9/2003 | Baitz et al. | 235/7 R |
| 6,976,634 | B2 | 12/2005 | Washington et al. | |
| 8,317,089 | B2 | 11/2012 | Brexel et al. | |
| 2003/0071048 | A1 | 4/2003 | Black et al. | |
| 2005/0173515 | A1 | 8/2005 | Sawa | |
| 2010/0247000 | A1 * | 9/2010 | Goodwin | B65D 33/34 383/43 |
| 2011/0181416 | A1 | 7/2011 | Dietz et al. | |
| 2012/0323361 | A1 | 12/2012 | Brexel et al. | |
| 2013/0036951 | A1 | 2/2013 | Dietz et al. | |
| 2013/0055931 | A1 | 3/2013 | Dietz | |
| 2014/0012761 | A1 * | 1/2014 | Schmidt et al. | 705/50 |

FOREIGN PATENT DOCUMENTS

| | | | |
|---|---|---|---|
| DE | 10-2010-004669 | A1 | 7/2011 |
| EP | 0418 098 | A1 | 3/1991 |
| EP | 1544807 | A2 | 6/2005 |
| JP | 09153162 | A * | 6/1997 |
| WO | WO-01-29786 | A1 | 4/2001 |
| WO | WO-02-076850 | A1 | 10/2002 |
| WO | WO-2006-012997 | A2 | 2/2006 |
| WO | WO-2008-092754 | A1 | 8/2008 |
| WO | WO 2009031237 | A1 * | 3/2009 |

OTHER PUBLICATIONS

International Search Report (in German and English) and Written Opinion (in German) for PCT/EP2011/072046, mailed Mar. 5, 2012; ISA/EP.

* cited by examiner

CASH CASSETTE WITH ELECTRONIC MONEY SEAL

CROSS-REFERENCE TO RELATED APPLICATIONS

This application is a National Stage of International Application No. PCT/EP2011/072046, filed Dec. 7, 2011, and published in German as WO 2012/076592 A1 on Jun. 14, 2012. This application claims the benefit and priority of German Application No. 10 2010 061 069.0, filed Dec. 7, 2010. The entire disclosures of the above applications are incorporated herein by reference.

BACKGROUND

This section provides background information related to the present disclosure which is not necessarily prior art.

Technical Field

The invention relates to a device for receiving notes of value comprising a base body with at least one opening for supplying and/or removing the notes of value and a lid for closing this opening. Further, the device comprises at least one sensor for detecting the opening of the lid. Another aspect of the invention relates to a device for displaying the opening of a lid closing the opening of a base body of a cash box, wherein the device comprises at least one sensor for detecting the opening of the lid that attachable to the base body and the lid.

Discussion

Known cash boxes comprise a base body having an opening for supplying and removing notes of value that is closable via a lid. After supplying and/or removing notes of value the lid is closed and a physical seal is applied via which an unauthorized opening of the lid is prevented. If the lid is opened, the physical seal has to be broken. This breach of seal can be detected by a control person and/or mechanically. From document DE 69928440 T2 for example a cash box with such a physical seal is known. The physical seal is in particular formed as an adhesive paper seal.

The problem with sealing a cash box with a physical seal is that upon opening this physical seal will be destroyed irreversibly, so that after each filling and/or emptying of the cash box a new seal has to be applied after the old seal was removed with considerable effort. This results in high costs and high expenditure. In particular, removing the residues of the adhesive by means of which the paper seal has been attached to the cash box requires great effort.

From document DE 10 2010 004 669 that has not been pre-published a device for receiving cash boxes is known, in which cash boxes are received, if notes of value are supplied to them and/or removed from them.

From document U.S. Pat. No. 6,976,634 B2 a cash box with a RFID chip is known.

From document US 2003/0071048 A1 a cash box with a display is known.

From document WO 2006/012997 A2 a display is known comprising an integrated RFID chip.

SUMMARY OF THE INVENTION

It is an object of the invention to designate a device for receiving notes of value and a device for displaying the opening of a lid which closes the opening of a base body of a cash box, wherein an unauthorized opening of a lid can be detected easily and which are designed in a simple and cost-effective manner.

By means of providing a display unit and a control unit that, at least when the sensor has detected an unauthorized opening of the lid, controls the display unit in such a manner that the display unit displays information on the opening of the lid, it is achieved that the function of the physical seal, namely displaying the unauthorized opening of the lid, is replaced by means of the display unit and the control unit. Thus, a physical seal is not necessary. In this way a kind of electronic seal is formed displaying a breach of seal. Thus, it is not necessary to provide a new physical seal after each opening of the lid. The electronic seal does not have any wear and tear parts that must be replaced each time when the lid is opened. Thus, a simple, cost-effective design is achieved and the handling is simplified.

Displaying information on the opening of the lid also means that a previously displayed information is not displayed any longer or is only displayed partly. In particular, the lid is hinge-connected to the base body.

The sensor particularly comprises a switch, preferably a micro switch being operated upon opening of the lid and/or closing of the lid by means of the lid. In particular, upon closing and/or opening of the lid by means of the switch a previously opened electrical circuit is closed or a previously opened electrical circuit is opened. Alternatively or additionally, different sensors can be provided for detecting the opening of the lid.

The device for receiving notes of value is in particular a cash box into which notes of value, in particular banknotes, can be received. The control unit controls the display unit in particular in such a manner that it displays the opening of the lid immediately after opening of the lid. By this, it is achieved that the breach of seal of the electronic seal, namely the opening of the lid, is displayed immediately and thus can be noticed by everyone.

A further aspect of the invention relates to a device for displaying the opening of a lid closing an opening of a base body of a cash box, wherein the device comprises a sensor that is attachable to the base body and the lid for detecting the opening of the lid, and a display unit. A control unit controls the display unit at least when the sensor has detected an unauthorized opening of the lid in such a manner that the display unit displays information on the opening of the lid. By means of this device also an electronic seal is formed which can replace a physical seal. Via the device an unauthorized opening of the lid is made visible for everybody and it is not necessary to provide a physical seal that has to be replaced after each opening. In particular, by means of this device a retrofit solution is formed with which cash boxes that are not yet equipped with such an electronic seal can be retrofitted.

In particular, this retrofit solution comprises a first locking element being attachable to a lid and a second locking element formed complementary to the first locking element and being attachable to the base body. Between the first and the second locking element a releasable and reclosable connection can be formed, wherein the sensor detects an opening of the lid in dependence of the release of this connection. The connection is in particular designed in form of a snap fastener the release of which is detected by the sensor, so that the opening of the lid in case of a release of the connection between the locking elements can be detected. The detection can on the one hand take place by detecting the release itself and on the other hand by detecting that there is no longer a connection between the two locking elements. Between the locking elements in particular a clip and/or a snap-in connection is formed.

The sensor of the retrofit solution comprises in particular a switch, preferably a micro switch and/or a capacitive sensor. In particular, when the lid is closed and/or opened by means of the switch a previously opened electrical circuit is closed or a previously closed electrical circuit is opened. Alternatively or additionally, different sensors for detecting the opening of the lid can be provided. The switch and/or the capacitive sensor are particularly integrated into the clip and/or snap-in connection formed between the locking elements.

Further, it is advantageous if the retrofit solution comprises an energy storing unit for supplying the display unit, the control unit and/or the sensor with electrical energy. By this, it is achieved that the retrofit solution does not have to be connected to an energy storage unit of that cash box to which the retrofit solution is attached, but that it works autarkic from the cash box. It is especially advantageous if a rechargeable energy storage unit is used so that, when the energy storage unit is emptied, it can be recharged and does not have to be disposed of. In particular, batteries and/or accumulators are used as energy storage unit.

The following embodiments of the invention relate to the cash box according to the first aspect of the invention as well as to the retrofit solution according to the second aspect of the invention:

In a preferred embodiment of the invention the displayed information comprise a symbol, preferably a pictogram symbolizing the opening of the lid. Such a symbol can be easily detected visually by a person handling the device. Further, such a symbol can also be detected easily in a machine readable manner, so that the unauthorized opening of the lid, namely the "breach" of the electronic seal can be detected by means of a machine. Further, using such a symbol has the advantage that this symbol can be understood internationally independent of the language.

Additionally or alternatively, the information can comprise a machine readable code, in particular a bar code. This bar code replaces and/or corresponds especially to that bar code that has been previously applied to the physical seal and that could be read out by a machine.

Further, at least part of the information displayed by means of the display unit can be illustrated in plain text, in particular readable for an operator. Thus, it is achieved that the unauthorized opening of the lid can be detected by an operator without requiring means of a machine for reading out a machine readable code. Thus, in case of an unauthorized opening of the lid it can be reacted quickly. In particular, on the display unit the word "breach of seal" and/or a corresponding pictogram is displayed, so that, as in case of a physical seal, the unauthorized opening can easily be recognized as a breach of seal of the electronic seal. In this way the known perception of a breach of seal by the physical seals is also implemented in case of the electronic seal, so that this does not involve a great adjustment for the operator of the device.

It is advantageous if the device comprises a memory element in which data containing information on detecting the unauthorized opening of the lid are stored. The data can, if the cash box is received in a device for handling cash boxes, in particular in a so-called docking station, be read out by a machine, so that the unauthorized opening can be detected promptly in addition to the display via the display unit and may be prosecuted.

In the cash box the data and/or information on the opening are in particular stored in a memory element that is already provided in the cash box, so that no separate memory element for the function of the electronic seal has to be provided. Alternatively, a separate memory element can be provided in which those data are stored that were previously printed onto the physical seal. However, in the retrofit solution preferably an own separate memory element is provided so that no data transmission link to a potential memory element of that cash box to which the retrofit solution is attached, has to be established.

In the memory element after closing of the lid preferably data containing information on the unambiguous identification of the closing of the lid, particularly an identification number are stored. In this way, the locking cycle can be identified and it is guaranteed that unauthorized opening and subsequent closing of the cash box are prevented. For this purpose, particularly an unambiguous identification number is used, so that in case of closing the lid again in each case a new identification number is given.

The display unit displays the information preferably until the device has been received in a docking station. In case of the retrofit solution receiving the device in the docking station means in particular that the cash box to which the retrofit solution is attached, is received in the docking station. By means of a corresponding display of the information it is achieved that these are displayed long enough, so that they can be read out by a machine by the docking station and/or can be perceived by an operator inserting the device into the docking station.

In a preferred embodiment of the invention the display unit displays the information until deactivation information has been entered via an input unit. Thus, it is guaranteed that in case of an unauthorized opening of the lid, this opening is consciously perceived by an operator who subsequently enters the deactivation information. The input is carried out in particular via an input unit of a device for handling cash boxes, in particular a docking station, a rack or an automated teller machine.

The displayed information especially comprise information for an unambiguous identification of the cash box or the cash boxes to which the retrofit solution is attached. In this embodiment the displayed information comprises in particular a machine readable code having a digit sequence that comprises a first part for an unambiguous identification of the device and a second part via which the unauthorized opening of the lid is displayed. In this way the identification information as well as the breach of seal can be displayed in a simple and compact manner.

Moreover, the display unit can display information on the place of origin of the device, on the destination and/or an order number. The display of this information can in turn be performed as machine readable code and/or in plain text. The machine readable code is in particular a bar code. The display of this information and the display of information on unauthorized opening of the lid can take place simultaneously and/or in preset time intervals alternately via the display unit. In particular, by means of this display of additional information, it is achieved that by means of the electronic seal the same information that was previously printed onto the physical seal can be displayed.

Further, the device can comprise a RFID chip that can be read out by means of a RDID reader of a device for receiving cash boxes into which the device is inserted. Via this RFID chip data, in particular data containing information on the opening of the lid can be transmitted to the device for receiving cash boxes. In particular, it is advantageous to provide a RFID chip for the retrofit solution, so that the retrofit solution can communicate with a docking station and/or an automated teller machine and the data containing information on the unauthorized opening of the lid can be transmitted from the retrofit solution to the docking station and/or the automated teller machine.

Additionally or alternatively to the data transmission link by means of the RFID chip a plug connection between the device and the docking station and/or the automated teller machine can be established. For this purpose, the device in particular comprises a plug connector that is formed complementary to a plug connector of the docking station or the automated teller machine. Via the plug connection that can be established by means of the plug connectors data containing information on the opening of the lid can be transmitted.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawing.

DETAILED DESCRIPTION OF THE PREFERRED EMBODIMENTS

Example embodiments will now be described more fully with reference to the accompanying drawing.

Figure 1:
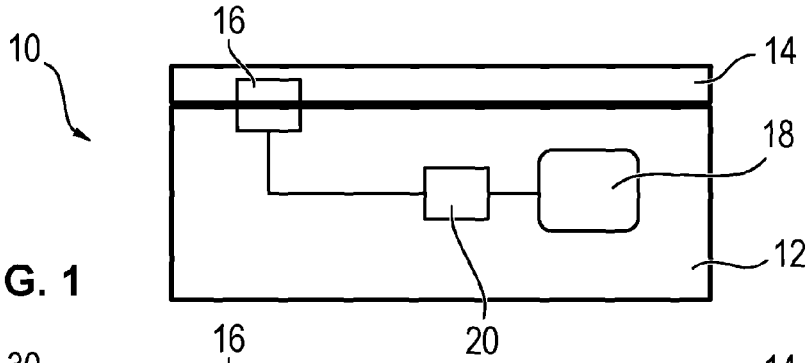
FIG. 1 is a schematic illustration of a cash box according to a first embodiment of the invention.

In FIG. 1 a schematic illustration of a cash box 10 according to a first embodiment of the invention is shown. The cash box 10 comprises a base body 12 that comprises an opening which can be closed via a lid 14 for feeding and/or removing notes of value. For feeding and/or removing the notes of value the lid 14 is opened and the notes of value are removed and/or inserted manually and/or by a machine. The filling and/or emptying of the cash box 10 is in particular carried out in a so-called cash center, wherein during emptying and/or filling the cash box 10 is preferably received in a so-called docking station. Such a docking station is known from the not pre-published document DE 10 2010 004 669 and is herewith included in the description by means of reference. After filling and/or emptying of the cash box 10 the lid 14 is closed again and is locked via a locking mechanism with the base body 12. In particular, the locking mechanism comprises a lock that can only be operated via a key intended for this purpose, so that the lid 14 can only be released and opened by persons, in particular employees of a security transport company or a bank possessing a respective key.

Further, the cash box 10 comprises a sensor 16 for detecting the opening of the lid 14. Furthermore, the cash box 10 has a display unit 18 as well as a control unit 20 for controlling the display unit 18. Furthermore, the cash box 10 is preferably provided with a not-illustrated further opening, via which notes of value can be supplied to and/or removed from the cash box 10 by means of a machine, if the cash box 10 is received in a device for handling notes of value, in particular an automated teller machine or a docking station. This further opening can be closed by means of a jalousie and/or a shutter, wherein the jalousie or the shutter are automatically opened during insertion of the cash box into the device via respective engagement elements, and during removal from the device are automatically closed. The further opening is in particular arranged at a front side of the cash box 10.

If the sensor 16 has detected the opening of the lid 14, it generates data and/or signals containing information on the opening of the lid 14 and transmits these data to the control unit 20. The control unit 20 consequently controls the display unit 18 in such a manner that it displays information on the opening of the lid 14.

The displayed information can comprise a symbol via which the opening of the lid is symbolized. Additionally or alternatively, via the display unit 18 the opening of the lid 14 can be illustrated in plain text, in particularly readable for an operator. Additionally or alternatively, the opening of the lid can be displayed via a machine readable code, in particular a bar code.

By means of the display unit 18 it is achieved that the opening of the lid 14 can be easily detected by an operator of the cash box 10 and/or by means of a machine. Thus, in particular a misuse of the key for releasing the locking mechanism by a person possessing such a key can be recognized. By means of displaying on a visible display unit 18 the opening of the lid 14 can be recognized by everybody as soon as it has happened, so that a potential manipulation attempt is recognized promptly and may be prosecuted. Thus, a form of electronic seal is formed that replaces a known physical seal for displaying an unauthorized opening of the lid 14. Compared to the physical seal the electronic seal has the advantage that it can be re-used as often as desired by re-setting each time upon insertion of the cash box 10 into a docking station and after removal and/or filling the display of the display unit 18 in such a manner that the opening of the lid 14 is no longer displayed by the display unit 18. Thus, no wear and tear parts occur saving costs and expenditure and achieving an environmental-friendly solution.

After opening the display unit 18 displays in particular the word "breach of seal", so that for an operator it is obvious without requiring any more interpretation that the electronic seal has been "broken", e.g. the lid 14 has been opened. In addition to the potential "breach of seal" via the display unit 18 also the place of origin of the cash box 10, the destination of the cash box 10, an order number and/or data containing information on an unambiguous identification of the cash box 10, in particular an identification number of the cash box 10, can be displayed. By this, it is achieved that that by means of the electronic seal, in particular by means of the display unit 18, all information are displayed that were previously printed onto a physical seal, so that on the cash box 10 no paper-like or papery printed media have to be applied.

The displayed information can particularly comprise a digit sequence, wherein a first part of the digit sequence serves for an unambiguous identification of the cash box 10. A second part of the digit sequence indicates whether the lid 14 has been opened or not. For this purpose, the control unit 20 comprises particularly a digit generation unit for generating a sequence of digits. Additionally or alternatively, the control unit 20 can be provided with a barcode generation unit for generating barcodes.

After filling and/or emptying of the cash box 10 the lid 14 will be closed as previously described. The filling and/or emptying is in particular performed when the cash box 10 is inserted into a docking station. After closing the lid 14 in particular an identification number is transmitted from the docking station to the cash box 10, in order to guarantee that the cash box 10 is not opened by an unauthorized person and that subsequently the lid 14 is closed again and the display unit 18 is reset. Resetting the display unit means in particular that it does not any longer display information on the opening of the lid 14. This identification number corresponds to an identification number of the physical seal, by means of which it is assured that after breach of seal the physical seal will not be replaced by another seal without being noticed.

Figure 2:
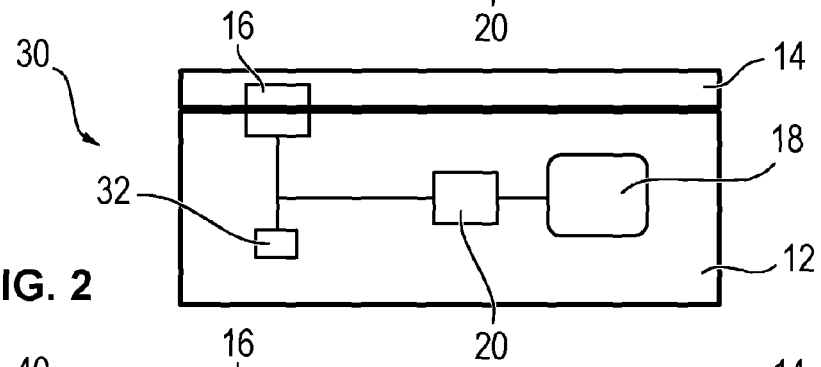
FIG. 2 is a schematic illustration of a cash box according to a second embodiment of the invention.

FIG. 2 shows a schematic illustration of a cash box 30 according to a second embodiment of the invention. Elements having the same structure and/or the same function are identified with the same reference signs. In this embodiment of the invention the cash box 30 comprises in addition a memory element 32, wherein upon detection of an opening of the lid 14 data and information on this opening are stored by the sensor 16 in the memory element 32. Upon insertion of the cash box 30 into a docking station the data stored in the memory element are read out by the docking station, so that the opening of the lid 14 can be displayed via the docking station and/or the data can be processed further electronically.

In an alternative embodiment of the invention the cash box 30 may not be provided with a display unit 18, but may only comprise the memory element 32. In this embodiment of the invention upon detecting an opening of the lid 14 by the sensor 16 only the data containing information on this opening are stored in the memory element 32 and are read out after insertion into a docking station. There is no additional display visible for everybody via a display unit 18. The advantage of this is that a person transporting the cash box 30 cannot find out by means of trying how far the lid 14 can be opened without being detected by the sensor 16. By means of a lack of the display unit 18 the person handling the device does not get a feedback as to at which opening the opening will be detected and at which opening not.

Figure 3:
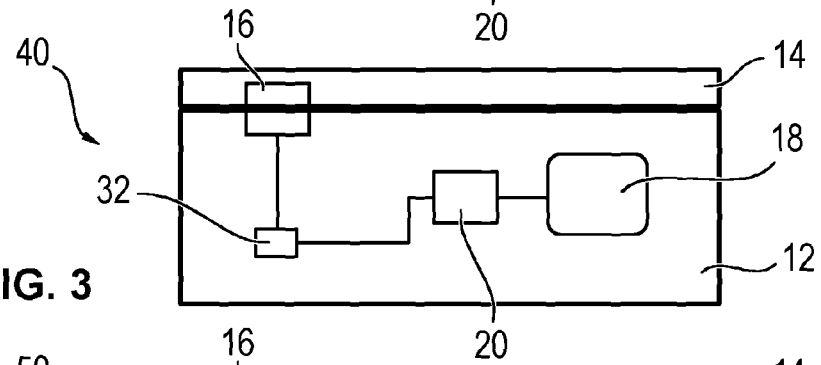
FIG. 3 is a schematic illustration of a cash box according to a third embodiment of the invention.

In FIG. 3 a schematic illustration of a cash box 40 according to a third embodiment of the invention is shown. In this embodiment the sensor 16 transmits data containing information of the opening of the lid 14, unlike as is the case with the embodiments according to FIGS. 1 and 2, not directly to the control unit 20, but transmits these data exclusively to the memory element 32. The control unit 20 reads out the data from the memory element 32 and thereupon controls the display unit 18 accordingly as described in case of the first two embodiments.

Figure 4:
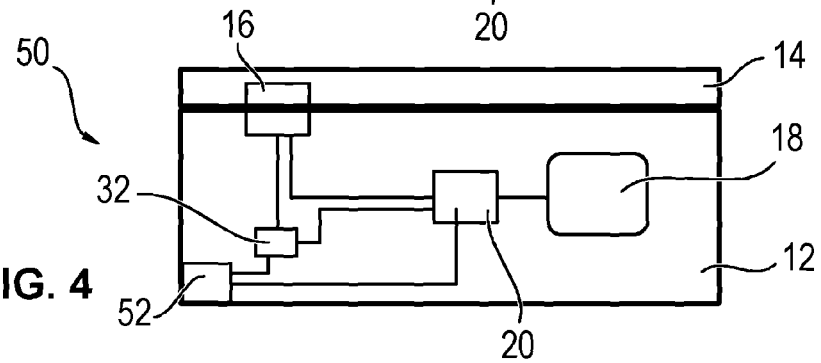
FIG. 4 is a schematic illustration of a cash box according to a fourth embodiment of the invention.

In FIG. 4 a schematic illustration of a cash box 50 according to a fifth embodiment of the invention is shown. In this embodiment of the invention the cash box 50 comprises a RFID chip 52 via which data containing information on the opening of the lid 14 are transmittable to a docking station, if the cash box 50 is inserted into this docking station. In particular, by means of the RFID chip 52 those data being stored in the memory element 32 can be transmitted to the docking station.

In an alternative embodiment of the invention the cash box 50 may not comprise a memory element 32. In this case, via the RFID chip 52 especially those data being displayed by the display unit 18 can be transmitted to the docking station.

In a further alternative embodiment of the invention alternatively or additionally to the RFID chip 52 a plug connector can be provided by means of which the cash box 50 can be connected to a further plug connector of the docking station formed complementary to this plug connector. Via this plug connection also those data can be transmitted as are transmitted in the above-described embodiment by means of the RFID chip 52.

Figure 5:
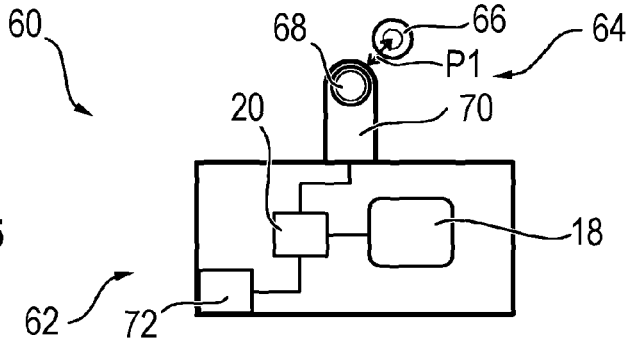
FIG. 5 is a schematic illustration of a device for displaying the opening of a lid of a cash box.
Figure 6:
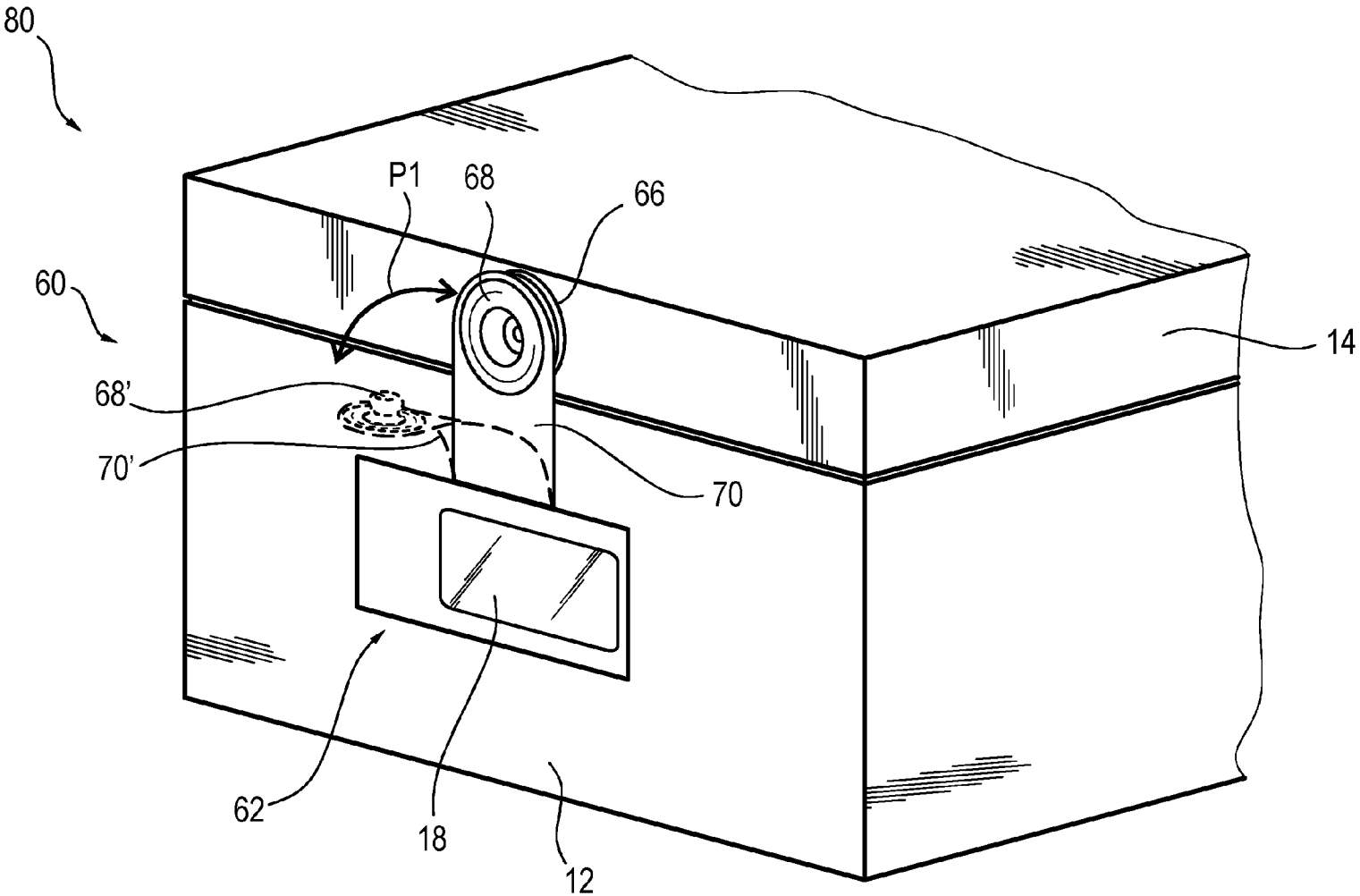
FIG. 6 is a schematic illustration of a cash box and of the device connected to it according to FIG. 5.

In FIG. 5 a schematic illustration of a device 60 for displaying the opening of a lid 14 sealing an opening of a base body 12 of a cash box 10, 30, 40, 50, 80 is shown. In particular, the device 60 serves as a retrofit solution for cash boxes 80 that, unlike the previously described embodiments, are not provided with an electronic seal. In FIG. 6 a schematic perspective view of such a cash box 80 is shown, wherein the device 60 is attached to the cash box 80 according to FIG. 5.

The device 60 comprises a base unit 62 that can be connected to the base body 12 of a cash box 10, 30, 40, 50. The base unit 62 is particularly adhered, screwed, riveted and/or welded to the base body 12.

The device 60 comprises a sensor 64 for detecting the opening of the lid 14. This sensor 64 in turn comprises a first locking element 66 that, if the device 60 is attached to a cash box 80, is firmly connected to the lid 14 of the cash box 80. The first locking element is in particular adhered, screwed, riveted and/or welded to the lid 14.

Further, the sensor 64 comprises a second locking element 68 that is connected to the base unit 62 via a flexible element 70, especially a flat ribbon. Via the locking elements 66, 68 as indicated by the double arrow P1 a releasable and reclosable connection can be established. In FIG. 6 the second locking element 68 and the flexible element 70 are illustrated in closed condition by continuous lines and are identified with the reference signs 68 and 70. In released condition the second locking element 68' and the flexible element 70' are illustrated with dashed lines and identified with the reference signs 68' and 70'. The first locking element 66 is attached to the lid 14 of the cash box 10, 30, 40, 50 in such a manner that an opening of the lid 14 is only possible, if the connection between the locking elements 66, 68 is released. Due to a release of the connection between the locking elements 66, 68 the sensor 64 detects the opening of the lid 14.

The deformable element 70 comprises a data transmission link via which data generated by the sensor 64 containing information on the opening of a lid 14 and/or signals are transmittable to a control unit 20 of the device 60 that hereupon controls the display unit 18 of the device 60 in such a manner that it displays information on the opening of the lid 14.

The features mentioned previously in connection with the embodiments one to four with regard to information displayed via the display unit 18 apply accordingly to the information for the device 60 displayed via the display unit 18. The device 60, as previously described for the cash boxes 10, 30, 40, 50 can also comprise a memory element 32 in which data containing information on the opening of the lid 14 are stored. Further, the device 60 can be provided with a RFID chip 52 by means of which data containing information on the opening of the lid 14 can be transmitted to a docking station, if that cash box 80 to which the device 60 is attached, is inserted into this docking station. The features mentioned previously in connection with the embodiments one to four with regard to the transmission of information between the docking station and the cash boxes 10, 30, 40, 50 apply accordingly to the transmission of information between the device 60 and the docking station.

Furthermore, the device 60 comprises a battery 72 for supplying the control unit 20, the display unit 18 and/or the sensor 64 with electrical energy. In this way it is achieved that the device 60 can be operated independently of an energy supply of the cash box 80 and that no interface being required between the retrofit solution 60 and the cash box 80 to which it is attached. In this way the device 60 can be mounted in an especially easy way.

The releasable and reclosable connection between the locking elements 66, 68 is in particular formed as a clip and or snap-in connection. In particular, the locking elements 66, 68 can be formed by a snap fastener. Thus, in a simple and cost-effective way a reclosable connection is established, so that the device 60 may be closed and opened as often as required.

In an alternative embodiment of the invention the device 60 may not be provided with a display unit 18, but may only comprise a memory element 32. In this embodiment of the invention upon detection of an opening of the lid 14 by the sensor 64 only the data containing information on this opening are stored in the memory element 32 and are read out in a docking station after insertion. There is no additional display visible for everybody via a display unit 18. The advantage of this is that a person transporting the cash box 80 cannot find out by means of trying how far the lid 14 can be opened without being detected by the sensor 64. By means of a lack of the display unit 18 the person handling the device does not get a feedback as to at which opening the opening will be detected and at which opening not.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for receiving notes of value, said device comprising:

a base body with at least one opening for supplying and/or removing notes of value;

a lid for closing the opening;

a sensor for detecting opening of the lid;

a memory element;

a first locking element attached to the lid and a second locking element formed complementary to the first locking element attached to the base body, in that between the first locking element and the second locking element a releasable and reclosable connection is established, and that the sensor detects an opening of the lid depending on the release of the connection between the first locking element and the second locking element; and wherein information is stored in the memory element when the sensor detects the opening of the lid; and wherein:

the first locking element is attached to a side face of the lid and has a mating part; and the second locking element is a flexible member attached at one end to a side of the body, the other end of the flexible member having a mating part that is releasably coupled to the mating part of the first locking element.

2. The device according to claim 1, wherein, in the memory element, an identification number containing information on an unambiguous identification of the closing of the lid, is stored.

3. The device according to claim 1, wherein the device comprises a plug connector via which a data transmission link for transmitting data containing information on the opening of the lid can be established by a plug connector of a device for receiving cash boxes that is formed complementary to the plug connector of the device.

4. The device of claim 1, which further comprises:

a docking station into which the base body is inserted; and wherein information stored in the memory element is read out by the docking station.

5. The device of claim 1, which further comprises:

a display unit that displays information stored in the memory element about unauthorized opening of the lid.

6. The device according to claim 5, wherein the device comprises an energy storing unit for supplying the display unit and the sensor with electrical energy.

7. The device according to claim 5, wherein the displayed information comprises a symbol symbolizing the opening of the lid.

8. The device according to claim 5, wherein the displayed information comprises a machine readable code.

9. The device according to claim 5, wherein at least part of the information is displayed in plain text readable for an operator.

10. The device according to claim 5, wherein the display unit displays the information until the device has been inserted into a device for handling cash boxes.

11. The device according to claim 5, wherein the display unit displays the information until via an input unit of a device for handling cash boxes in which the device is received, deactivating information has been entered.

12. The device according to claim 5, wherein the information displayed by the display unit comprises information on identification of the device.

13. The device according to claim 5, wherein the display unit displays information on the place of origin of the device, information on the destination and/or an order number as machine-readable code and/or in plain text.

14. The device of claim 5 wherein the display unit displays information about an origin of the device and information regarding the destination of the device.

* * * * *